US005493733A

United States Patent [19]

Pospisil

[11] Patent Number: 5,493,733

[45] Date of Patent: Feb. 27, 1996

[54] CAP PROVIDING SUN PROTECTION FOR EARS

[76] Inventor: Robert L. Pospisil, 36930 Lake Unity Rd., Fruitland Park, Fla. 34731

[21] Appl. No.: 303,954

[22] Filed: Sep. 9, 1994

[51] Int. Cl.[6] ..... A42B 1/06

[52] U.S. Cl. ..... 2/195.1; 2/209; 2/209.13; 2/423

[58] Field of Search ..... 2/171, 172, 175.1, 2/175.6, 195.1, 209, 209.13, 410, 422, 423, 909, 918

[56] References Cited

U.S. PATENT DOCUMENTS

| | | | |
|---|---|---|---|
| 782,769 | 2/1905 | Wallach | 2/209.13 |
| 2,140,630 | 12/1938 | Illguth . | |
| 2,676,325 | 4/1954 | Carlson | 2/172 |
| 4,316,290 | 2/1982 | Montesi . | |
| 4,633,530 | 1/1987 | Satterfield . | |
| 4,932,076 | 6/1990 | Giorgio et al. . | |
| 5,007,110 | 4/1991 | Gilbert . | |
| 5,121,507 | 6/1992 | Brown . | |
| 5,125,113 | 6/1992 | Yun . | |
| 5,153,943 | 10/1992 | Clement . | |

*Primary Examiner*—Diana Biefeld
*Attorney, Agent, or Firm*—Julian C. Renfro

[57] ABSTRACT

A cap having an arrangement for shielding the ears of a wearer from direct sunlight by the use of a pair of generally elongate ear shades removably supported from the sides of the cap. This novel cap has a head-encircling portion and a crown portion as well as support devices for the ear shades. These support devices are mounted on opposite sides of the head-encircling portion, at locations generally corresponding to the temporal portions of a wearer's head. Each of the support devices is adapted for supporting one of the ear shades, with both of the ear shades being double-ended and of non-planar construction. A securing component is disposed on each end of each ear shade, adapted for engagement with the respective support device. Each ear shade, when mounted in one orientation on a respective support device, is disposed relatively close to the respective ear of the wearer, such that the ear will be shaded from the sun, whereas when mounted on the support device in an opposite orientation, the ear shade will disposed in a position relatively close to the crown of the cap, leaving the respective ear unshaded.

10 Claims, 2 Drawing Sheets

CAP PROVIDING SUN PROTECTION FOR EARS

FIELD OF THE INVENTION

This invention relates to the field of hat and cap accessories, and more particularly involves novel ear shade that can be attached in a readily demountable relationship to a cap. Once in place in a particular orientation, these ear shades protect the wearers ears from direct rays of the sun.

BACKGROUND OF THE INVENTION

Many people spend time in the sun each day, and by way of example, some construction workers may be continuously exposed to strong sunlight for eight hours a day. This prolonged exposure can lead to a number of physical problems. The sun exposure can at a minimum cause a sunburn of the skin, but over a long period of time, repeated over-exposure to the sun may well result in skin cancer. Exposure to the sun is particularly critical in certain regions of the southern hemisphere, for example, where depletion of the ozone layers has made it highly desirable for head protection to be worn by almost everyone venturing outside during periods of the day when the sun's rays are most intense.

I am aware that various headgear arrangements of this general type have been proposed in the past, and by way of example, the Brown U.S. Pat. No. 5,121,507 entitled "Headgear Accessory Attachment" provides members that are attachable to certain headgear, to accomplish a shielding of the wearer's ear and neck areas from the sun.

The Yun U.S. Pat. No. 5,125,113 entitled "Visored Cap with Front, Side and Rear Shades" teaches an elaborately configured visored cap collapsibly supporting a front shade and side shades, thus to protect certain head portions of the wearer from the sun. Of some interest is the fact that side shades utilized in the Yun device are divided into a front portion and a rear portion, with the rear portions in some embodiments being once again divided.

The Clement U.S. Pat. No. 5,153,943 entitled "Weather-Shield Hat Accessory" teaches the use of a flexible weather-shield that can be attached to a wide variety of hats by the use of VELCRO, which is generically known as a hook and loop fastener.

Many of these arrangements have proven to be generally satisfactory, although the cost of some has been rather large. Even more significant in some instances is the fact that if a wearer merely wants to protect his ears from the direct rays of the sun, the elaborate arrangements in accordance with the prior art may make the head quite warm, and bring about a profuse amount of perspiration.

It was in an effort to improve upon these prior art arrangements that the present invention was evolved.

SUMMARY OF THE INVENTION

In accordance with this invention I have provided a cap having support means usable in connection with a pair of generally rectangularly shaped, double ended ear shades or ear shields utilized for shielding the ears of a wearer from direct sunlight. These novel ear shades are demountable, meaning that they each may be attached to the support means on the cap in either of two positions or orientations. In a first orientation, the ear shades serve to shield the ears of the wearer from the sun, whereas in a second position, they are disposed in an out-of-the-way or retracted relationship, in which the ear shades reside relatively close to the crown of the cap.

The ear shades are of non-planar configuration, meaning that they may be either curved or creased, so that when mounted in the aforementioned first orientation on the support means of the cap, they will be in an ear-shading relationship, whereas when they are turned end-for-end and mounted in their second orientations on the cap, they will be in retracted or folded positions.

By the selective use of these novel ear shades or ear shields, the ears of a person prone to develop sunburn or skin cancers can be readily protected from too much exposure to harmful rays of the sun, but when no longer needed, the ear shades can be remounted on the cap in out-of-the-way positions.

The support means or mounting means I utilize for the attachment of these novel ear shades to a cap are located on the temporal portions of the cap. I am aware that the word temporal has more than one meaning, with one meaning pertaining to time, and another meaning pertaining to something secular or material. However, I am using the word temporal in an entirely different, medically-related context, to indicate a relationship to the temples or to the sides of the skull behind the orbits. As persons familiar with physiology are aware, the temporal bone is a compound bone on each side of the human skull having four principal parts. Each of the novel ear shades I utilize is mounted on a portion of a cap disposed approximately at the location of the temporal bone of the wearer of the cap.

In accordance with a first embodiment of this invention, I may utilize ear shades or ear shields supported on the cap by the use of VELCRO, which of course is generically known as a hook and loop fastener. Hook-type VELCRO, for example, may be provided as the support means on opposite temporal portions of the cap, and in such instance, loop-type VELCRO would be utilized on each end of each ear shade. As a result of such an arrangement, when the loop-type VELCRO on a first end of each ear shade is attached to the hook-type VELCRO on the cap, the ear shields will be in their ear-protecting positions, whereas when the ear shades are turned end-for-end, such that the second ends of the ear shades are in contact with the hook-type VELCRO, the ear shades will be disposed in their out-of-use positions in which the ears remain unshaded.

A hook and loop fastener such as VELCRO is not required in all embodiments of my novel ear shields, for I may utilize clip means on the temporal portions of the cap, into which clip means the securing means utilized on each end of each ear shade may be inserted. When VELCRO is not being used, the securing means of the ear shades are the essentially flat, opposite ends of the ear shades. The clip means utilized on the temporal portions of the cap may be mechanically held in place, or, alternatively, the clip means may be held in place by VELCRO.

It is therefore to be seen that a primary object of my invention is to provide highly effective protection from the sun for the ears of a person threatened with sunburn or skin cancer. with such protection being provided at a very reasonable cost.

It is another object of my invention to provide sun protection for the ears of a person wearing a cap or other headpiece, with such sun protection being provided without causing the head of the wearer to unduly perspire, as is often the case when the large, bulky ear-shading headgear of the prior art is utilized.

It is yet another object of my invention to provide novel sun shades that are easily attachable to a cap in a desired relationship to the ears of the wearer of the cap, such that the sun shades may be conveniently and readily disposed either in an ear-shielding relationship, or in retracted, out-of-the-way positions.

It is yet still another object of my invention to provide novel sun shades utilized in combination with a cap, which sun shades are readily demountable, such that they may be conveniently attachable to a cap in either of two relationships, with the sun shades disposed either in ear-shielding relationships, or in out-of-the-way positions close to the crown of the cap.

These and other objects, features and advantages will become more apparent from a study of the enclosed drawings.

DETAILED DESCRIPTION

Figure 1:
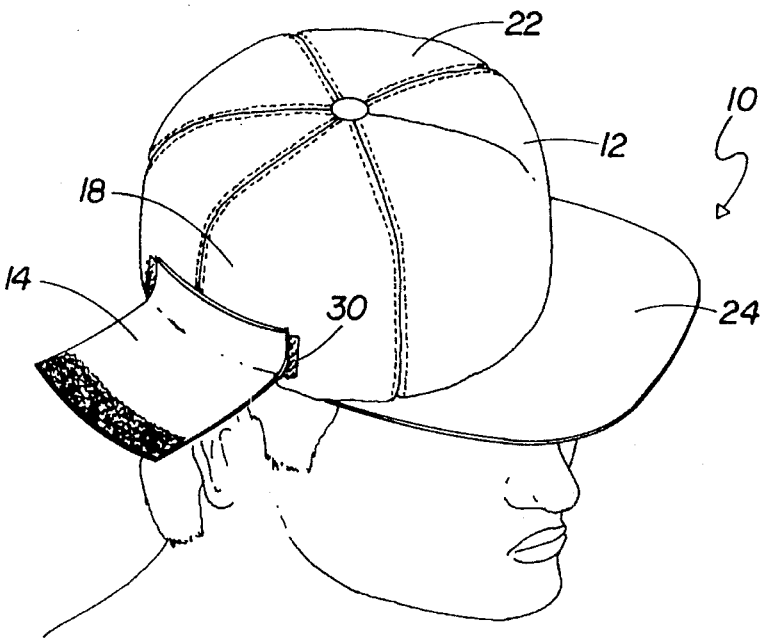
FIG. 1 is a perspective view of a cap provided with support means in locations just above the ears of a wearer, which support means enable novel, double-ended ear shades in accordance with this invention to be mounted either in ear-shielding relationships to the ears of the wearer, or else in out-of-the-way positions.

With initial reference to FIG. 1, it will be seen that I have provided a novel ear protection arrangement 10 involving a cap 12 having means for shielding the ears of a wearer from direct sunlight by the use of readily demountable, generally rectangularly shaped ear shades or ear shields. A first embodiment of an ear shade, ear shade 14, is visible in FIG. 1, whereas a pair of ear shades in accordance with this same embodiment, shades 14 and 16, are visible in FIG. 2 in their mounted positions on temporal portions 18 of the cap.

By the selective use of these elongate, double-ended ear shades or ear shields, the ears of a person prone to develop sunburn or skin cancers can be advantageously protected from too much exposure to harmful rays of the sun, without requiring the bulky, ear shading arrangements of the prior art, which frequently caused the head of the wearer to perspire profusely.

Figure 2:
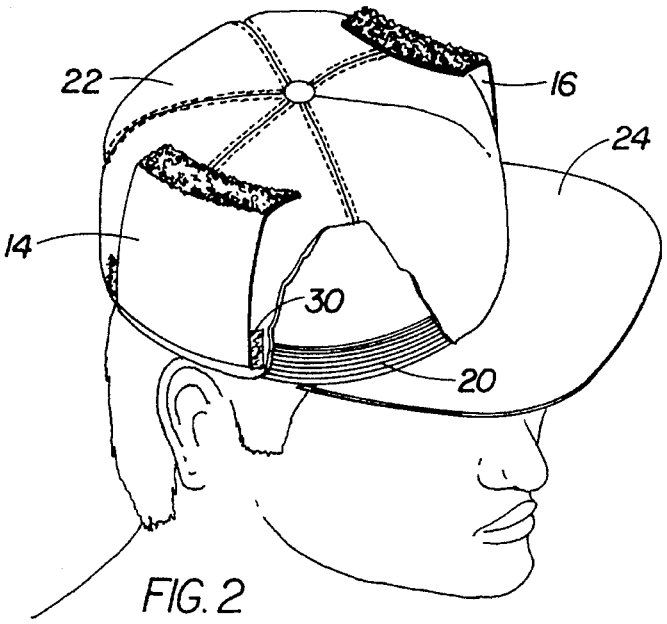
FIG. 2 is a perspective view generally resembling FIG. 1, but in this instance showing the ear shields attached to the cap in retracted, out-of-the-way positions.

The cap 12 has a head-encircling portion 20, visible in the broken-away portion of FIG. 2, and a crown portion 22. Although the head-encircling portion 20 is typically on the interior of the cap and not the exterior, it is to be understood that the head encircling portion forms the bulk or principal amount of the support for the ear shades I use. The cap 12 may, in addition, have a bill or visor portion 24, but this is not a requisite of my design.

It is important to note that I utilize support means 30 on opposite sides of the head-encircling portion 20, at locations generally corresponding to the temporal portions of the wearer's head, or in other words, at the locations just above the wearer's ears. The support means 30, one of which is visible in FIGS. 1 and 2, are in most instances supported, in effect, from the head-encircling portion 20, for the lower crown portions of the cap do not, generally speaking, serve by themselves to tightly grasp the head of the wearer. Each of the support means (support device) 30 is adapted for supporting a respective one of the generally rectangularly shaped ear shades.

Figure 3:
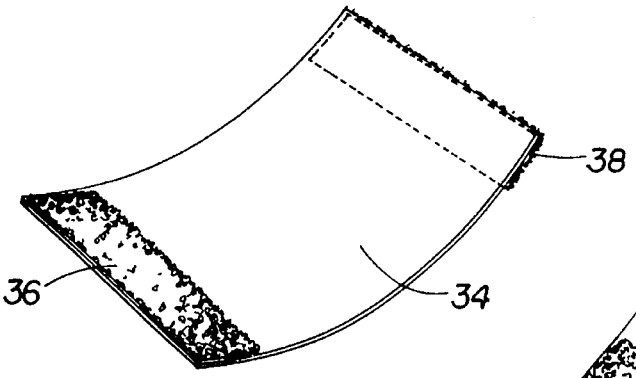
FIG. 3 reveals a first embodiment of an ear shield in accordance with this invention, wherein loop-type VELCRO is mounted at each end of the ear shield, but on opposite sides of the ear shield, with this particular ear shield possessing a substantially uniform amount of curvature.
Figure 4:
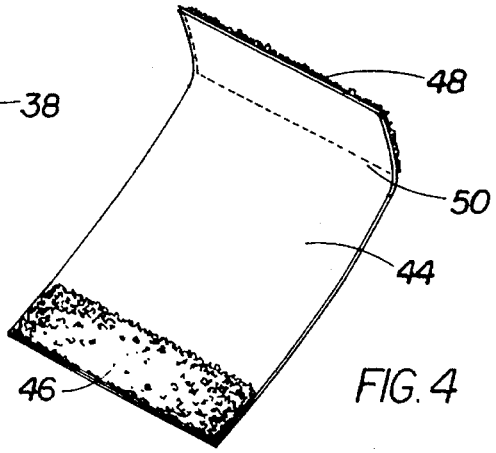
FIG. 4 reveals a second embodiment of an ear shield in accordance with this invention, wherein loop-type VELCRO is mounted at each end of the ear shield, and wherein a severe crease is formed at one end of the ear shield, so that the ear shield may be attached to the cap in either of two relationships above the ears of the wearer.

With reference to FIGS. 3 and 4, two somewhat different embodiments of ear shades or ear shields are illustrated, with each of the pair of ear shades being double-ended and of non-planar construction. I describe the ear shades as being of non-planar construction inasmuch as one embodiment of an ear shade usable with my novel cap arrangement may possess curvature of the type depicted in FIG. 3, whereas another embodiment of an ear shade may have a deep fold or severe crease, as depicted in FIG. 4.

I utilize securing means on both ends of each ear shade, with the arrangement being such that when an ear shade is mounted in an orientation on the respective supporting means as depicted in FIG. 1, the respective ear of the wearer will be shaded, whereas when mounted in an opposite orientation, that is, when the ear shade has been turned end-for-end and then re-attached to the support means 30, the ear shade will be disposed in an out-of-use position relatively close to the crown 22 of the cap, as shown in FIG. 2. At this time the ear remains unshaded.

In FIG. 3 the securing means or securing component for the ear shade 34 involves a first piece of a suitable type of fastening material such as loop-type VELCRO 36 at one end of the ear shade, in this instance on the concave side thereof, and a second piece of loop-type VELCRO 38 at the other end Of the ear shade. In this latter instance, the VELCRO is on the convex side of the ear shade. As should be obvious from this construction, when the loop-type VELCRO 38 is attached to the supporting means 30, the ear shade 34 will be in the position protecting the wearer's ear from the direct rays of sunlight. In many instances the wearer has the option of positioning the convex side of the ear shade up, or the convex side down.

When the loop-type VELCRO 36 representing the other securing means for this ear shade is attached to the supporting mean 30, however, the ear shade 14 will be in the out-of-use position indicated in FIG. 2.

With reference to FIG. 4, the securing means for ear shade 44 may involve a first piece of loop-type VELCRO 46 at one end of the ear shade, and a second piece of loop-type VELCRO 48 at the other end of the ear shade. The ear shade 44 may have originally been of flat or planar construction, but then a deep fold or severe crease 50 was formed adjacent the VELCRO 48. This crease facilitates, when the ear shade is in one orientation, the ear shade being positioned near the wearer's ear, rather than extending undesirably far above the ear. As is obvious, when the ear shade is turned end-for-end and then re-attached to the support means 30, such as of hook type VELCRO, the ear shade is then disposed in an out-of-use position near the crown of the cap.

As is obvious, I am not to be limited to this exact usage of VELCRO, for I could use loop type VELCRO on the exterior sides of the cap, and hook type VELCRO on the ends of the ear shades.

Figure 5:
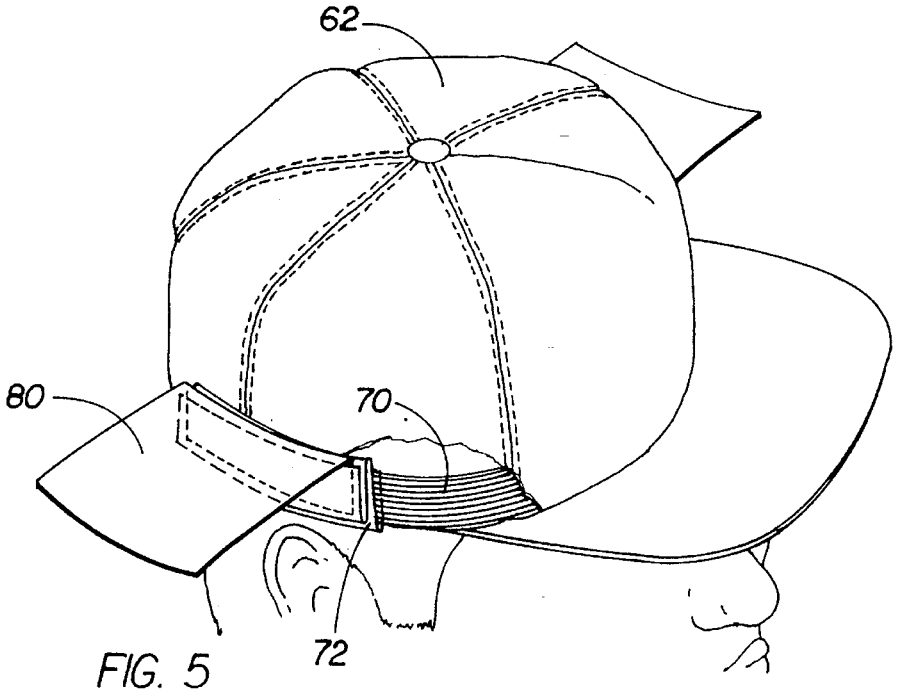
FIG. 5 is a perspective view of a cap in accordance with an embodiment of this invention in which clip means rather than VELCRO is utilized on the cap for supporting the ear shade in an ear-protecting manner.
Figure 6:
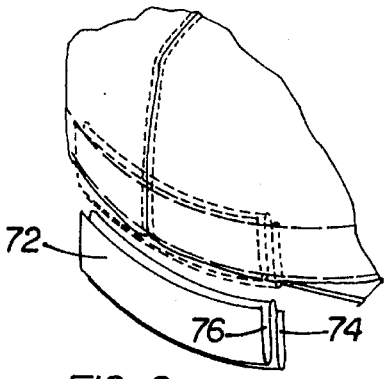
FIG. 6 is a perspective fragmentary view of the clip of FIG. 5, in a position just before insertion upon the head-encircling portion of the cap.
Figure 7:
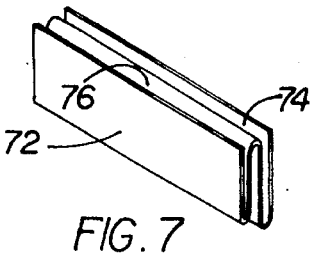
FIG. 7 is a perspective view of the clip, with this view revealing that the clip has approximately a "W" shaped cross section.

Turning now to FIG. 5 it will be seen in this embodiment of my invention that the cap 62 is equipped with a head encircling portion 70, and upon each side of the head encircling portion 70, a clip 72 of generally W-shaped configuration is mounted, to serve as the support means for the respective ear shade. As will be noted from FIG. 5 as well as FIGS. 6 and 7, each clip 72 has upwardly extending slot portions 74 and 76, with the slot portion 74 being intended to be slid over the head encircling portion 70 of the cap 62, to mechanically engage same. The upwardly extending slot portion 76 is designed to receive one or the other of the securing means utilized at each end of each ear shade 80. In connection with the use of the clip means 72, the securing means utilized on each end of the ear shade 80 can take the form of a relatively flat surface.

Figure 8:
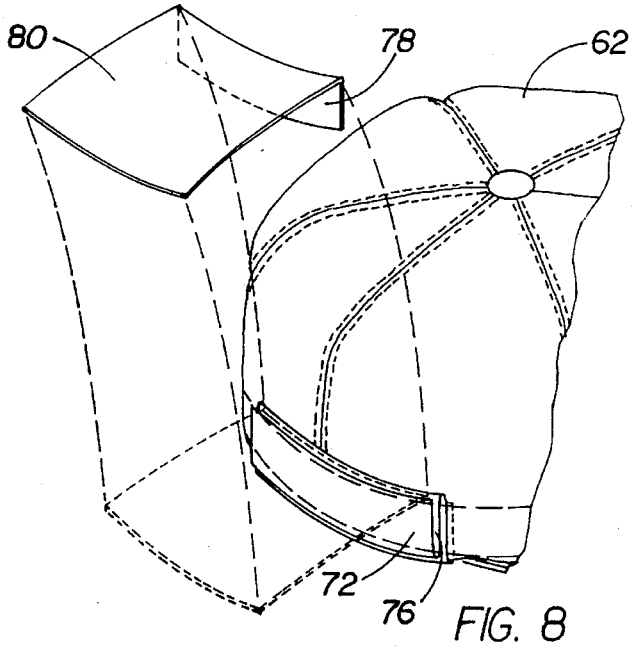
FIG. 8 is a perspective view, revealing the ear shade in an exploded relationship to a clip mechanically attached to the cap.

In FIGS. 5 and 8, it is to be understood that the creased end 78 of ear shade 80 is received, with the consequence that the ear shade is in the ear-protecting position. As is obvious, if the ear shade is turned end-for-end, and the opposite securing means of the ear shade is inserted into the upwardly extending slot 76, the ear shade 80 will be disposed in the out-of-use position. It is to be noted that the clip 72 of FIGS. 5 through 8 is held in place on the cap entirely by mechanical means, and no VELCRO is utilized.

Figure 9:
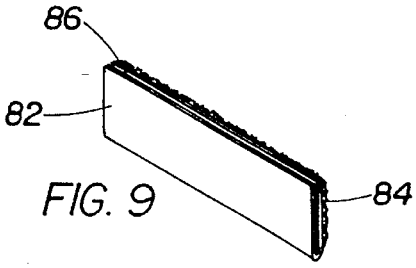
FIG. 9 is a perspective view of a different type of clip than that depicted in FIGS. 5 through 8, with this clip utiliizing VELCRO for its attachment to the temporal portion of the cap, rather than mechanical means.

In contrast, in FIG. 9 I reveal a clip 82, which represents a support means that is of U-shape cross-section, rather than being of W-shaped configuration. Only a single upstanding slot 86 is provided in this embodiment, into which one or the other flat ends of a sun shade in accordance with this invention is inserted. VELCRO 84, such as of loop type VELCRO, is provided on the side of the clip 82 that is opposite from the slot 86, with the VELCRO 84 enabling clip 82 to be firmly attached to hook type VELCRO utilized on the exterior part of the head encircling portion 70 of the cap. Obviously I am not limited to this precise usage of VELCRO, for I could utilize hook type VELCRO on the back of the clip, and loop type VELCRO on the exterior of the temporal portions of the cap.

There is no requirement for any particular material to be utilized in the manufacture of the ear shades, but I typically prefer to utilize a fairly stiff type of plastic, typically an industrial grade plastic, which can be expected to maintain the particular configuration into which it is initially bent.

It should now be obvious that I have provided an inexpensive yet very effective arrangement for protecting the ears of a cap wearer from the direct rays of the sun, with this being accomplished with a minimum of complexity. As a result, not only is cost quite low, but also the amount of components to be worn on the head of the wearer is minimized, thus to reduce the likelihood of the wearer perspiring to an inordinate extent.

I am not to be limited to the illustrated embodiments except as required by the scope of the appended claims.

I claim:

1. A cap having means for shielding the ears of a wearer from direct sunlight by the use of a pair of generally elongate ear shades, said cap having a head-encircling portion and a crown portion, support means located on opposite sides of said head-encircling portion, at locations generally corresponding to the temporal portions of a wearer's head, each of said support means being adapted for supporting one of said ear shades, both of said ear shades being double-ended and of non-planar construction, securing means disposed on each end of each ear shade, adapted for engagement with said support means, each ear shade, when mounted in one orientation on a respective support means, being disposed relatively close to the respective ear of a wearer, such that the respective ear will be shaded from the sun, whereas when the ear shade is moved into an opposite orientation and the other securing means brought into engagement with said support means, the ear shade will be disposed in a position relatively close to the crown of the cap, leaving the respective ear unshaded.

2. The cap having means for shielding the ears of a wearer from direct sunlight as recited in claim 1 in which each of said ear shades possesses curvature, with one side of each ear shade being concave and the other side being convex, such curvature causing an alteration of the shading effect upon the ear shade being turned end for end.

3. The cap having means for shielding the ears of a wearer from direct sunlight as recited in claim 1 in which one end of each ear shade has a severe crease at a location adjacent the respective securing means, said severe crease being responsible for the alteration of the shading effect upon the ear shade being turned end for end.

4. The cap having means for shielding the ears of a wearer from direct sunlight as recited in claim 1 in which said support means involves a clip means mounted on said head-encircling portion of said cap, said clip means having a slot therein for receiving either of the securing means provided on the ends of each ear shade.

5. The cap having means for shielding the ears of a wearer from direct sunlight as recited in claim 4 in which said clip means is secured to said head-encircling portion by the use of a hook and loop fastener.

6. A cap having means for shielding the ears of a wearer from direct sunlight by the use of readily demountable, generally rectangularly-shaped ear shades, said cap having a head-encircling portion and a crown portion, support means located on opposite sides of said head-encircling portion, at locations generally corresponding to the temporal portions of a wearer's head, each of said support means being adapted for supporting one of said ear shades, both of said ear shades being double-ended and of non-planar construction, securing means disposed on each end of each ear shade, such securing means being designed to interfit with and to be mounted upon said support means, each ear shade, when mounted in a first orientation on a respective support means, being disposed relatively close to the respective a of the wearer, such that the respective ear will be shaded from the sun, whereas when mounted in a second orientation, the ear shade will disposed in a position relatively close to the crown of the cap, at such time leaving the ear unshaded.

7. The cap having means for shielding the ears of a wearer from direct sunlight as recited in claim 6 in which each of said ear shades possesses curvature, with one side of each ear shade being concave and the other side being convex, such curvature causing an alteration of the shading effect upon the ear shade being turned end for end.

8. The cap having means for shielding the ears of a wearer from direct sunlight as recited in claim 6 in which one end of each ear shade has a severe crease at a location adjacent the respective securing means, said severe crease being responsible for the alteration of the shading effect upon the ear shade being turned end for end.

9. The cap having means for shielding the ears of a wearer from direct sunlight as recited in claim 6 in which said support means involves a clip means mounted on said head-encircling portion of said cap, said clip means having a slot therein for receiving either of the securing means provided on the ends of each ear shade.

10. The cap having means for shielding the ears of a wearer from direct sunlight as recited in claim 9 in which said clip means is secured to said head-encircling portion by the use of a hook and loop fastener.

* * * * *